US005477312A

United States Patent [19]

Hori

[11] Patent Number: 5,477,312

[45] Date of Patent: Dec. 19, 1995

[54] METHOD OF CONTROLLING IMAGE DENSITY

[75] Inventor: Kazuto Hori, Osaka, Japan

[73] Assignee: Mita Industrial Co., Ltd., Osaka, Japan

[21] Appl. No.: 262,661

[22] Filed: Jun. 20, 1994

[30] Foreign Application Priority Data

Jul. 16, 1993 [JP] Japan ..... 5-198984

[51] Int. Cl.[6] ..... G03G 21/00

[52] U.S. Cl. ..... 355/208; 355/246

[58] Field of Search ..... 355/208, 214, 355/246, 205, 207

[56] References Cited

U.S. PATENT DOCUMENTS

| | | | |
|---|---|---|---|
| 4,801,980 | 1/1989 | Arai et al. | 355/206 |
| 5,006,896 | 4/1991 | Koichi et al. | 355/246 |
| 5,097,293 | 3/1992 | Seto et al. | 355/208 |
| 5,122,835 | 6/1992 | Rushing et al. | 355/208 |
| 5,245,390 | 9/1993 | Ishigaki et al. | 355/246 |
| 5,333,037 | 7/1994 | Inoue et al. | 355/203 |

*Primary Examiner*—Robert Beatty

*Attorney, Agent, or Firm*—Beveridge, DeGrandi, Weilacher & Young

[57] ABSTRACT

A method of controlling image density includes imaging a pattern of reference density as a toner image on a photoconductor. The density of the toner image is detected by a reflection-type photosensor, and parameters on the image density are adjusted based upon the results of this detection. In this invention, prior to measuring the reference density toner image, the drive current for the reflection-type photosensor is varied, and output from the reflection-type photosensor is measured while no toner is present on the photoconductor. A reference value of the drive current for the reflection-type photosensor which permits output from the reflection-type photosensor to be a predetermined value is determined. Then, the drive current for the reflection-type photosensor for measuring the reference density toner image is set based on the reference drive current value.

13 Claims, 4 Drawing Sheets

METHOD OF CONTROLLING IMAGE DENSITY

FIELD OF THE INVENTION

The present invention relates to a method of controlling image density in an image formation apparatus including a copying machine.

PRIOR ART TECHNOLOGY

In a copying machine, usually an original image is exposed to light to form an electrostatic latent image on a photoconductor drum. After that, the electrostatic latent image is developed by a developing device to form a toner image on the photoconductor drum, and the toner image is transferred to a recording sheet by a transfer device.

To obtain appropriate image density, a fixed density of the toner image related to a specified density of an original image must be retained. Thus, in the prior art, adjustment of parameters on density, including the quantity of exposing light, the potential of electrostatic charge of the photoconductor and the developing bias, is performed as discussed below.

First, a pattern of reference density is exposed to light so that the pattern of the reference density is imaged on a photoconductor drum as an electrostatic latent image. After development of the image, density of the resultant toner image on the photoconductor drum is detected by a reflection-type photosensor. Eventually, the parameters on density are adjusted based upon output from the reflection-type photosensor.

In such a method of the prior art, however, there arises an error in detection of density of the toner image related to the pattern of the reference density due to variations in characteristics of a light emitting element and a light receiving element of the reflection-type photosensor, variations in positional relation between these elements, variations in mounting position of the reflection-type photosensor, foulness on a light emitting surface of the light emitting element and a light receiving surface of the light receiving element, variations with elapse in components such as deterioration, and environmental variations including temperature and humidity. Thus, the prior art technique has the disadvantage that density adjustment cannot be performed precisely.

SUMMARY OF THE INVENTION

It is an object of the present invention to provide a method of controlling image density, in which the density of a toner image related to a pattern of reference density can be precisely detected, and thus, precise density adjustment can be performed.

The present invention is directed to a method of controlling image density where a pattern of reference density is imaged as a toner image on a photoconductor, density of the toner image is detected by a reflection-type photosensor, and parameters on image density are detected based upon the results of detection by the reflection-type photosensor; the method comprising the steps of, in the state where no toner lies on the photoconductor, varying a drive current for the reflection-type photosensor to measure output from the reflection-type photosensor, finding a reference value of the drive current for the reflection-type photosensor at which the output from the reflection-type photosensor reaches a predetermined fixed level, and setting the drive current for the reflection-type photosensor to the reference value of the drive current in measuring the density of the toner image related to the pattern having the reference density.

The parameters on image density include the quantity of exposing light, the level of electrostatic charge of the photoconductor and the developing bias. The process of finding the reference value of the drive current may be necessarily performed before measuring the density of the toner image, or it may be performed every fixed period of time or for every predetermined number of image formations.

In accordance with the present invention, density of a toner image related to a pattern of reference density can be precisely detected, and thus, precise density adjustment can be performed.

DETAILED DESCRIPTION OF THE PREFERRED EMBODIMENT

Preferred embodiments of the present invention will be described below with reference to the accompanying drawings.

Figure 1:
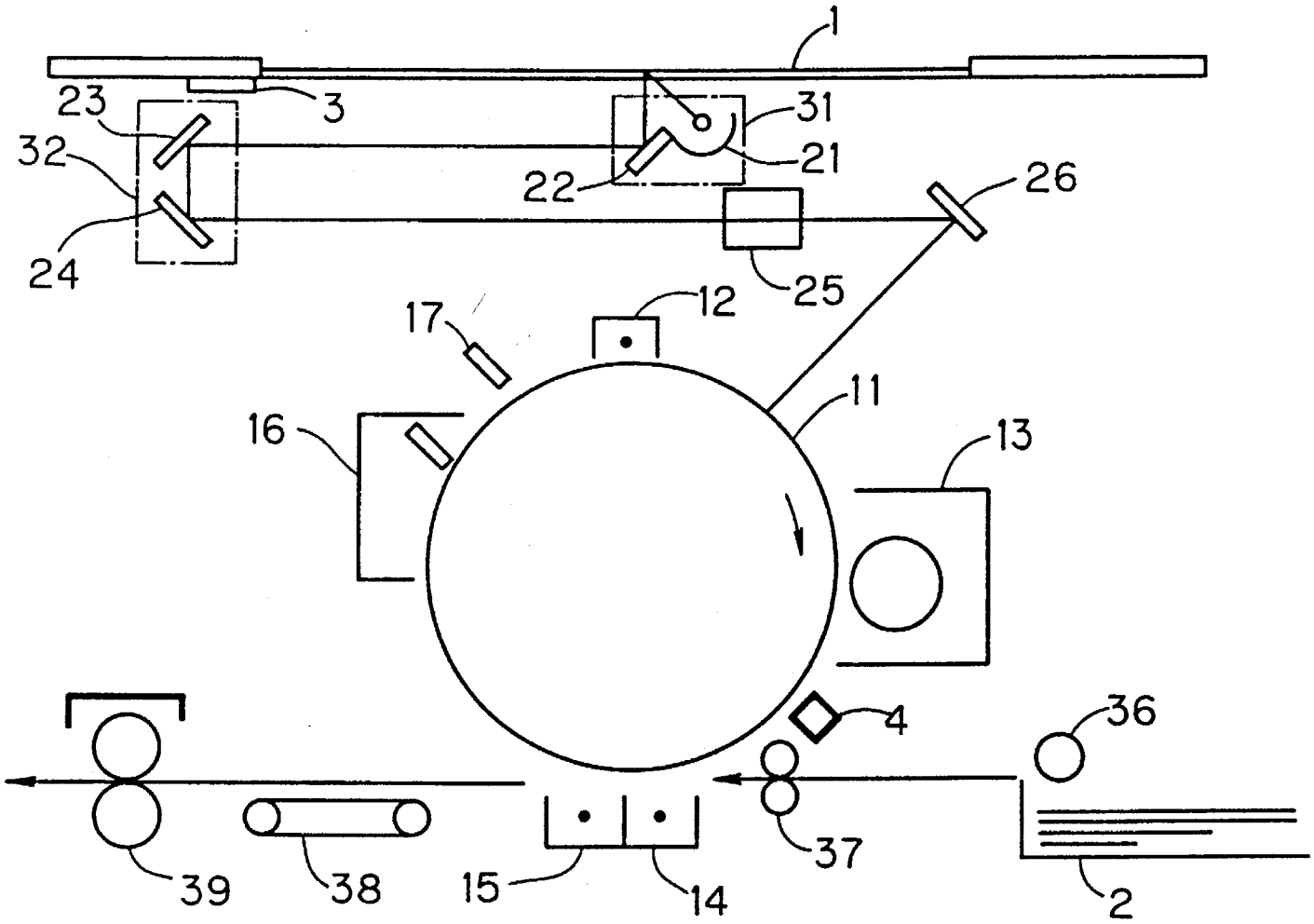
FIG. 1 is a schematic diagram showing an arrangement of a copying machine.

FIG. 1 depicts an exemplary arrangement of an electrophotographic copying machine.

In top of a cabinet of the copying machine, there is provided a contact glass plate 1 on which an original sheet to be copied is put in position. A sheet cassette 2 is attached in one side of the cabinet of the copying machine. Within the cabinet of the copying machine, an exposing mechanism, a printing mechanism and a recording sheet carriage mechanism are disposed. A sample original 3 where a pattern of reference density is recorded is attached close to one side of the contact glass plate 1.

The printing mechanism has a photoconductor drum 11. The photoconductor drum 11 is revolved by a main motor (not shown) in a direction shown by the arrow in FIG. 1. The following devices surround the photoconductor drum 11: an electrostatic charging device 12 for electrifying a photoconductive layer in the surface of the photoconductor drum 11, a developing device 13 for imaging an electrostatic latent image formed on the photoconductive layer as a toner image, a transfer discharging device 14 for transferring the toner image on the photoconductive layer onto a recording sheet, a release discharging device 15 for releasing the recording sheet from the photoconductor drum 11, a cleaning device 16 for removing toner remaining on the photoconductor drum 11 after image transfer, and a discharger 17 for releasing electric charge from the surface of the photoconductor drum 11. These devices are arranged in this order with respect to rotation of the photoconductor drum 11.

Also, around the photoconductor drum 11, a reflection-type photosensor 4 is placed between the developing device 13 and the transfer discharging device 14.

The exposing mechanism includes a first optical carriage 31 consisting of an exposing lamp 21 for exposing and scanning an image of an original Sheet (not shown) set on the contact glass plate 1 and a first mirror 22 is provided for reflecting light reflected from the original sheet. A second optical carriage 32 consisting of second and third mirrors 23 and 24 is provided for guiding light reflected from the first mirror 22 toward a lens 25. A fourth mirror 26 guides light outgoing from the lens 25 onto the surface of the photoconductor drum 11.

The first and second optical carriages 31 and 32 are reciprocally moved in lateral directions in FIG. 1 by a scan motor (not shown). The second optical carriage 32 moves one-half times as fast as the first optical carriage 31, i.e., it moves one-half as far as the first optical carriage 31.

The recording sheet carriage mechanism includes a sheet supply roller 36 for supplying a recording sheet from the sheet cassette 2, a resist roller 37 for carrying the recording sheet to the photoconductor drum 11 at a specified timing, and a conveyer belt 38 for conveying the recording sheet to a fusing roller 39. A toner image is transferred from the photoconductor drum 11 to the recording sheet which is then released from the photoconductor drum 11.

Figure 2:
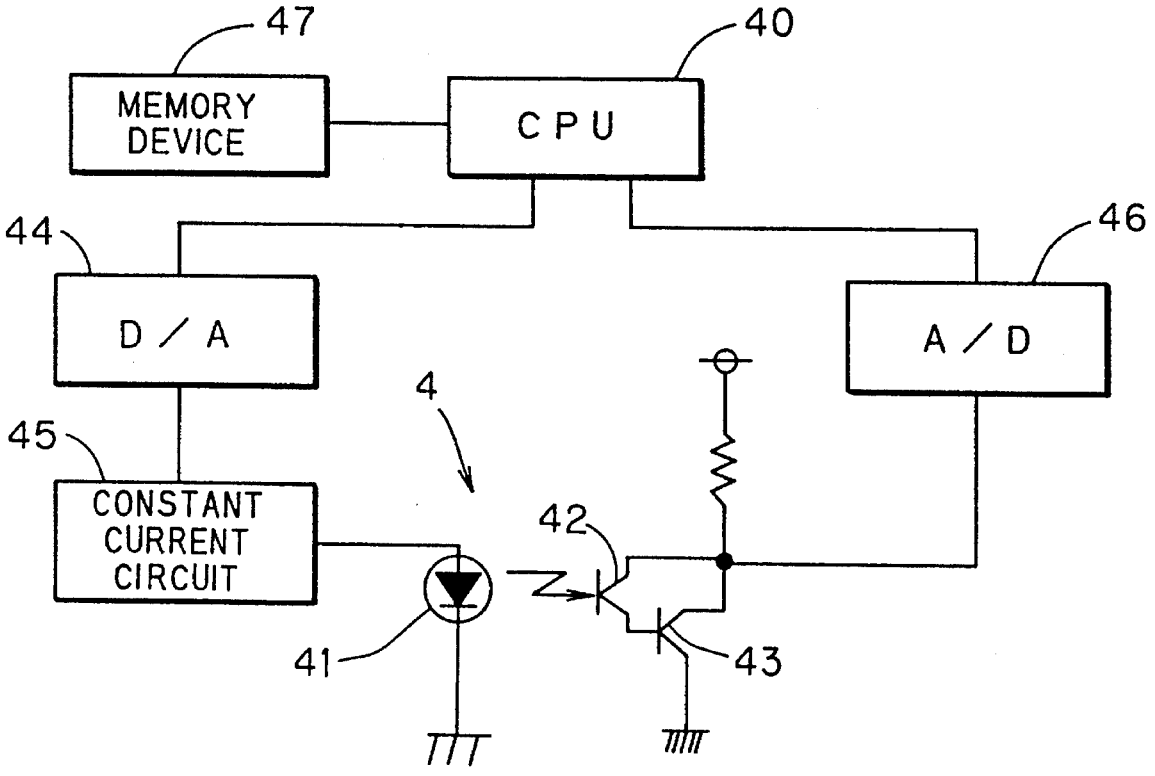
FIG. 2 is a block diagram of electric system architecture of a reflection-type photosensor and a drive control circuit of the same.

FIG. 2 depicts a system architecture of the reflection-type photosensor 4 and a drive control circuit for the same.

Figure 5:
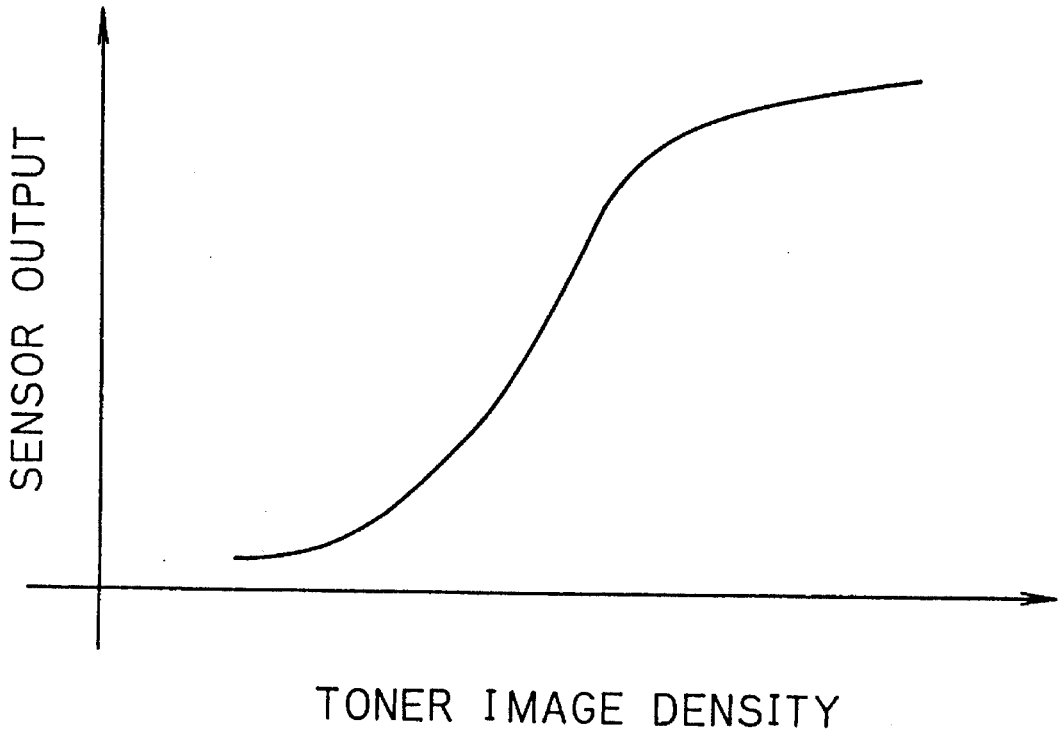
FIG. 5 is a graph expressing the relationship between density of a toner image and output from the reflection-type photosensor.

The reflection-type photosensor 4 is comprised of a light emitting element including a light emitting diode 41 illuminating the surface of the photoconductor drum 11, and a light receiving element including a photo-transistor 42 for receiving reflected light and A transistor 43 amplifies output from the photo-transistor 42. FIG. 5 illustrates the relationship between density of the toner image and output from the reflection-type photosensor 4 in the case where the specified drive current is utilized to drive the reflection-type photosensor 4.

The drive current of the light emitting diode 41 is controlled by a CPU 40 controlling the copying machine. Specifically, when a digital signal specifying the drive current is produced by the CPU 40, the signal is converted into an analog signal by a D/A converter 44 and then transmitted to a constant current circuit 45. The constant current circuit 45 applies to the light emitting diode 41 a drive current of a current value in accordance with the analog signal received from the D/A converter 44. Meanwhile, output from the light receiving element is, after being converted into a digital signal by an A/D converter 46, transmitted to the CPU 40. The CPU 40 has a memory device 47 for storing its own programs and necessary data.

Figure 3:
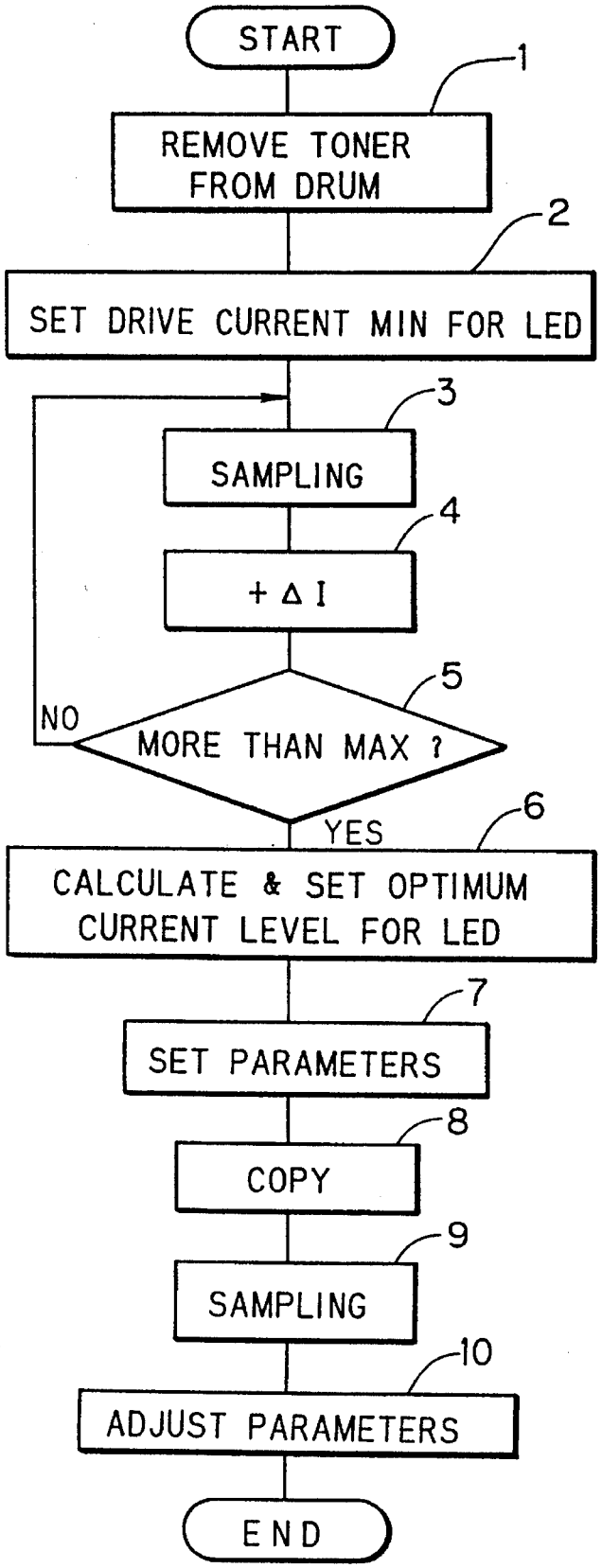
FIG. 3 is a flow chart illustrating a procedure for CPU adjustment of density.

FIG. 3 illustrates a procedure of density adjustment by the CPU 40.

First, toner on the photoconductor drum 11 is removed (Step 1). This is carried out, for example, by driving only the cleaning device 16 and discharger 17 of all the devices surrounding the photoconductor drum 11.

Then, a drive control signal is produced to supply a predetermined amount of minimum current MIN to the light emitting diode 41 (Step 2). This signal causes the constant current circuit 48 to supply the minimum current MIN to the light emitting diode 41, so that the light emitting diode 41 is operated.

Next, output from the light receiving element (sensor output) is taken in, and the sensor output is stored in the memory device 47 in connection with the drive current for the light emitting diode 41 (Step 3). After that, a drive control signal is produced so that the drive current for the light emitting diode 41 is increased by $\Delta$ I (Step 4). Thus, output current from the constant current circuit 45 is increased by $\Delta$ I.

Taking-in the sensor output (Step 3) and increasing the drive current (Step 4) are repetitively performed until the output current from the constant current circuit 45 goes beyond the predetermined maximum level, When the output current from the constant current circuit 45 becomes more than the maximum level (Step 5), a reference value of the drive current at which the sensor output takes a predetermined value A is obtained based upon data of the sensor output related to the drive current stored in the memory device 47 (Step 6). Thus, the output current from the constant current circuit 45 is set to the reference value of the drive current under control.

After that, parameters on density including the quantity of exposing light and charging voltage are set to values determined in the previous density adjustment (Step 7). Then, the pattern of the reference density is exposed to light to perform a copying operation (Step 8).

Then, density of the toner image related to the pattern of the reference density is detected, that is, output from the light receiving element is taken in (Step 9). In this way, the parameters on density including the quantity of exposing light and charging voltage are adjusted based upon the reference density value obtained through the previous steps (Step 10).

Figure 4:
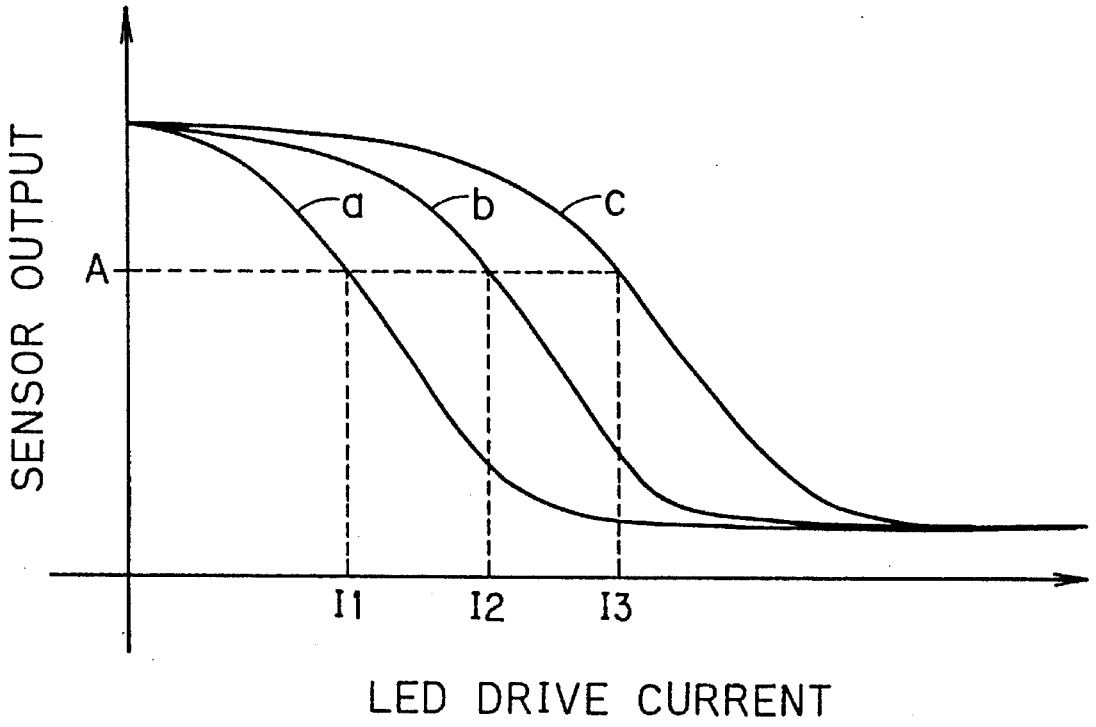
FIG. 4 is a graph expressing the relationship between drive current for the reflection-type photosensor and its output obtained in consequence with the density adjustment.

Data of the sensor output with respect to the drive current, which is obtained through the above-mentioned steps 1 to 5, is shown in FIG. 4. As expressed in curves "a", "b" and "c" in FIG. 4, variations in characteristic of the reflection-type photosensor, foulness on the light emitting and the light receiving surfaces, deterioration of the reflection-type photosensor, variations in temperature and humidity and/or the like are causes which vary output characteristics related to the drive current for the reflection-type photosensor. In the above embodiment, however, the reference drive current which permits the sensor output to reach the specified value A is found, and the density of the toner image relative to the pattern of the reference density is obtained while the reflection-type photosensor is being operated by the reference drive current. In this way, since measuring errors caused by output variations of the reflection-type photosensor due to various factors are corrected, precise density adjustment can be performed.

What is claimed is:

1. In a method of controlling image density where a reference density pattern is imaged as a toner image on a photoconductor, a density of the toner image is detected by means of a reflection-type photosensor, and parameters relating to image density are adjusted based upon results of detection by the reflection-type photosensor; the method comprises the steps of:

(i) varying a drive current for the reflection-type photosensor to measure output from the reflection-type photosensor in a state where no toner is present on the photoconductor;

(ii) finding a reference value of the drive current for the reflection-type photosensor which permits output from the reflection-type photosensor to reach a predetermined value, based upon results obtained in step (i); and (iii) setting the drive current for the reflection-type photosensor to the reference value when measuring the density of the toner image of the reference density pattern.

2. A method according to claim 1, wherein the step of finding the reference value of the drive current is performed immediately before measuring the density of the toner image of the reference density pattern.

3. A method according to claim 1, wherein the step of finding the reference value of the drive current is performed every fixed period of time.

4. A method according to claim 1, wherein the step of finding the reference value of the drive current is performed after a specified number of image formations.

5. A method according to claim 1, wherein the parameters relating to image density include at least one parameter selected from the group consisting of: a quantity of exposing light, a level of electrostatic charge applied to the photoconductor, and a developing bias.

6. A method according to claim 1, wherein, in step (i), the drive current for the reflection-type photosensor is varied at predetermined value intervals between a predetermined minimum value and a predetermined maximum value, and the output from the reflection-type photosensor is measured at each value of the drive current.

7. A method of controlling image density, comprising:

varying a drive current for a reflection-type photosensor and measuring output from the reflection-type photosensor in a state where no toner is present on a photoconductor;

finding a reference value of the drive current for the reflection-type photosensor which permits output from the reflection-type photosensor to reach a predetermined value, based upon results obtained from the step of varying the drive current;

setting the drive current for the reflection-type photosensor based on the reference value;

measuring a density of a toner image of a reference density pattern with the photosensor drive current set based on the reference value; and adjusting at least one parameter relating to image density based on the measured density of the reference density pattern.

8. A method according to claim 7, further comprising the step of cleaning toner from the photoconductor before varying the drive current.

9. A method according to claim 7, wherein the step of finding the reference value of the drive current is performed immediately before the steps of setting the drive current and measuring the density of the toner image.

10. A method according to claim 7, wherein the step of finding the reference value of the drive current is repeated after an elapse of a fixed period of time.

11. A method according to claim 7, wherein the step of finding the reference value of the drive current is repeated after a specified number of image formations.

12. A method according to claim 7, wherein the adjusting step includes adjusting at least one parameter selected from the group consisting of: a quantity of exposing light, a level of electrostatic charge applied to the photoconductor, and a developing bias.

13. A method according to claim 7, wherein in the step of varying the drive current, the drive current for the reflection-type photosensor is increased at predetermined intervals from a predetermined minimum, and the output from the reflection-type photosensor is measured at each drive current.

* * * * *